US010847891B2

(12) United States Patent
Ban et al.

(10) Patent No.: US 10,847,891 B2
(45) Date of Patent: Nov. 24, 2020

(54) ANTENNA DEVICE AND WIRELESS COMMUNICATION APPARATUS

(71) Applicant: FUJITSU LIMITED, Kawasaki (JP)

(72) Inventors: Yasumitsu Ban, Kawasaki (JP); Yohei Koga, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 22 days.

(21) Appl. No.: 16/228,140

(22) Filed: Dec. 20, 2018

(65) Prior Publication Data

US 2019/0214733 A1 Jul. 11, 2019

(30) Foreign Application Priority Data

Jan. 5, 2018 (JP) ..... 2018-000720

(51) Int. Cl.

| | |
|---|---|
| ***H01Q 1/24*** | (2006.01) |
| ***H01Q 9/32*** | (2006.01) |
| ***H01Q 1/48*** | (2006.01) |
| ***H01Q 9/42*** | (2006.01) |
| ***H01Q 1/34*** | (2006.01) |
| ***H01Q 13/26*** | (2006.01) |

(52) U.S. Cl.

CPC ..... *H01Q 9/32* (2013.01); *H01Q 1/245* (2013.01); *H01Q 1/34* (2013.01); *H01Q 1/48* (2013.01); *H01Q 9/42* (2013.01); *H01Q 13/26* (2013.01)

(58) Field of Classification Search

CPC ..... H01Q 9/32; H01Q 13/26; H01Q 1/34; H01Q 1/48; H01Q 1/241–245; H01Q 9/42

See application file for complete search history.

(56) References Cited

U.S. PATENT DOCUMENTS

| | | | | |
|---|---|---|---|---|
| 9,660,335 | B2 * | 5/2017 | Chen | H01Q 19/22 |
| 2003/0148784 | A1 | 8/2003 | Sawamura et al. | |
| 2004/0227683 | A1 * | 11/2004 | Caimi | H01Q 1/36 343/742 |
| 2005/0275598 | A1 * | 12/2005 | Ohara | H01Q 7/00 343/711 |
| 2009/0170570 | A1 | 7/2009 | Uejima et al. | |
| 2010/0149053 | A1 | 6/2010 | Nakano et al. | |
| 2012/0130206 | A1 * | 5/2012 | Vajha | A61N 1/37229 600/302 |
| 2013/0017786 | A1 | 1/2013 | Kvist et al. | |

(Continued)

FOREIGN PATENT DOCUMENTS

| | | | |
|---|---|---|---|
| JP | 2002-368850 | A | 12/2002 |
| JP | 2003-8342 | A | 1/2003 |
| JP | 2006-197138 | A | 7/2006 |

(Continued)

*Primary Examiner* — Awat M Salih

(74) *Attorney, Agent, or Firm* — Arent Fox LLP

(57) ABSTRACT

An antenna device includes a ground plane, and an antenna element formed on a first surface of the ground plane, the antenna element including a feed point, a first line extending from the feed point to a first end in a direction away from the first surface, a second line extending along the first surface of the ground plane from the first end of the first line to a second end, and a third line extending along the first surface of the ground plane from the second end of the second line to a third end in a direction different in plan view from an extending direction of the second line.

10 Claims, 11 Drawing Sheets

(56) References Cited

U.S. PATENT DOCUMENTS

| | | | |
|---|---|---|---|
| 2013/0308805 | A1 | 11/2013 | Ozden |
| 2018/0151956 | A1 | 5/2018 | Ban |

FOREIGN PATENT DOCUMENTS

| | | | |
|---|---|---|---|
| JP | 2013-541913 | A | 11/2013 |
| JP | 2018-85703 | A | 5/2018 |
| WO | WO-2007/004499 | A1 | 1/2007 |
| WO | WO-2009/028251 | A1 | 3/2009 |

* cited by examiner

110M4
111M4
111AM4
112M4
112AM4
111BM4
113M14
113AM4

110M5
111M5
111AM5
112M5
112AM5
111BM5
113M15
113AM5

110M6
111M6
111AM6
112M6
112AM6
111BM6
113M16
113AM6

110M7
111M7
111AM6
7
112M7
112AM7
111BM7
113M17
113AM7
X
Y
Z

ANTENNA DEVICE AND WIRELESS COMMUNICATION APPARATUS

CROSS-REFERENCE TO RELATED APPLICATION

This application is based upon and claims the benefit of priority of the prior Japanese Patent Application No. 2018-720, filed on Jan. 5, 2018, the entire contents of which are incorporated herein by reference.

FIELD

The embodiments discussed herein are related to an antenna device and a wireless communication apparatus.

BACKGROUND

There has been an antenna device configured to be used at or in proximity to a user body. The antenna device has an antenna structure including a first conducting element, the antenna structure being configured so that a current is induced in at least the first conducting element during operation. The first conducting element extends over a length of between 1/16 of a wavelength and a full wavelength in a direction substantially orthogonal to the surface of the user body when the antenna device is formed in an intended operational position. With the antenna device mentioned above, the electromagnetic field propagates primarily in a direction along the surface of the user.

With the existing antenna device, the electromagnetic field (electrical field) propagates primarily in a direction along a surface of the user. The direction along the surface of the user is a direction parallel to a ground plane of the antenna device.

That is, the existing antenna device, whose directivity is set such that the electrical field is distributed along a direction in which the ground plane spreads out, does not have a large directivity in a direction vertically away from the ground plane. Therefore, the existing antenna device is incapable of yielding a communication distance in a direction vertical to the ground plane.

The following is a reference document.

[Document 1] Japanese National Publication of International Patent Application No. 2013-541913.

SUMMARY

According to an aspect of the embodiments, an antenna device includes a ground plane, and an antenna element formed on a first surface of the ground plane, the antenna element including a feed point, a first line extending from the feed point to a first end in a direction away from the first surface, a second line extending along the first surface of the ground plane from the first end of the first line to a second end, and a third line extending along the first surface of the ground plane from the second end of the second line to a third end in a direction different in plan view from an extending direction of the second line, wherein a length from the feed point to the third end of the third line of the antenna element is a length corresponding to three-quarters of an electrical length of a wavelength at a resonant frequency of the antenna element, and wherein a vector of a resonant current flowing in the second line and a vector of a resonant current flowing in the third line at the resonant frequency reinforce each other.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Hereinafter, an embodiment to which an antenna device and a wireless communication apparatus of the present disclosure are applied will be described.

Embodiment

Figure 1A:
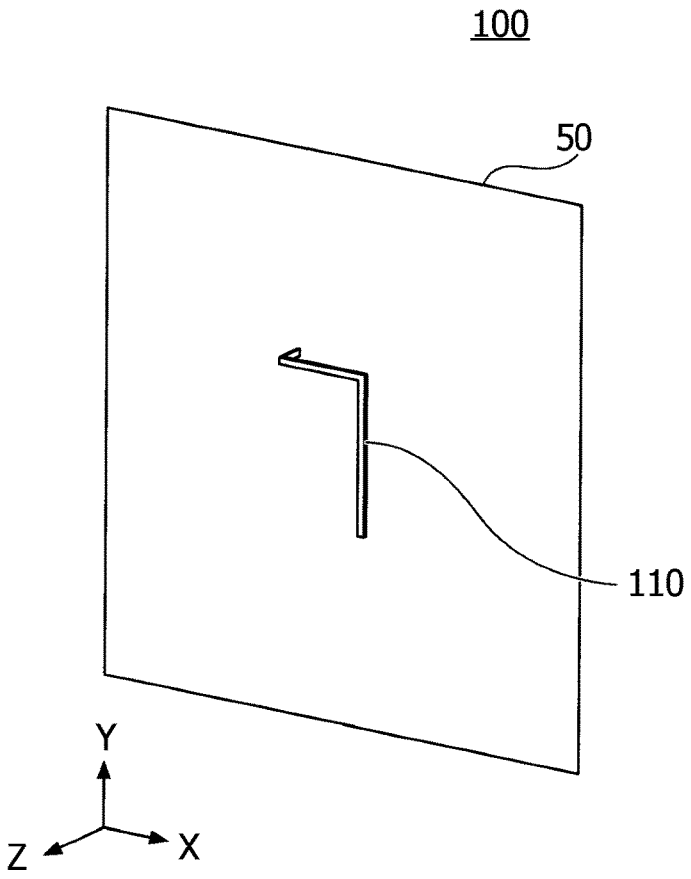
FIGS. 1A to 1C are diagrams illustrating an antenna device according to an embodiment.
Figure 1B:
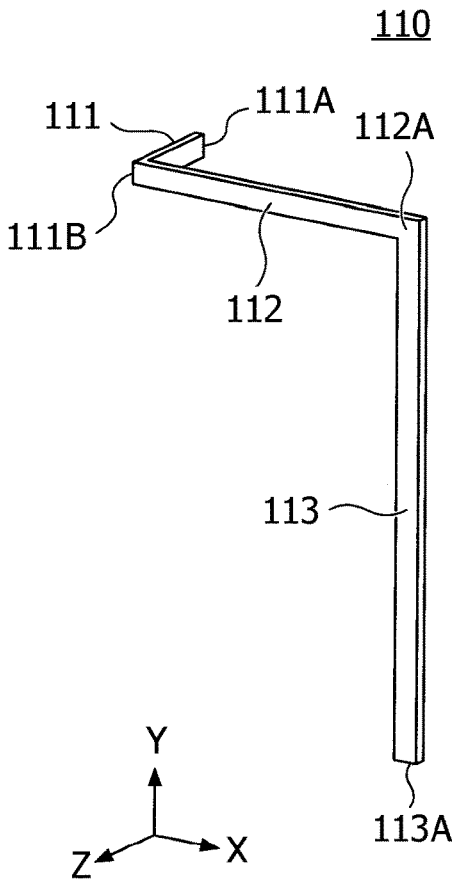
Figure 1C:
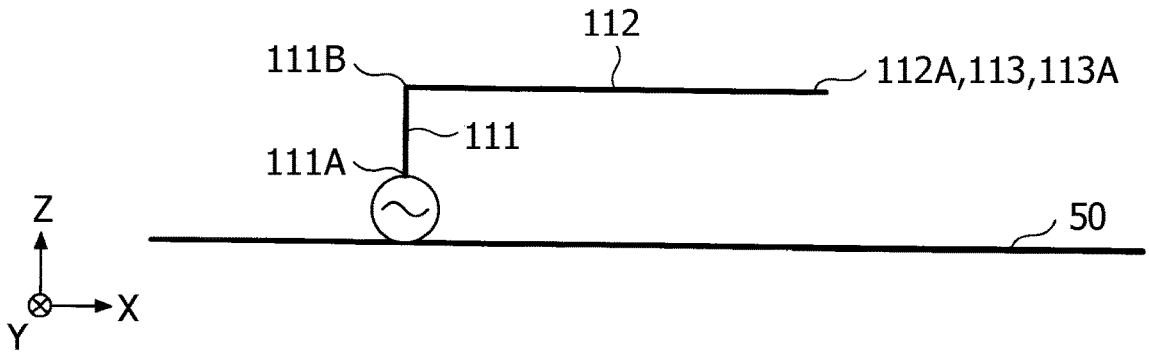

FIGS. 1A to 1C are diagrams illustrating an antenna device 100 according to an embodiment. FIGS. 1A and 1B illustrate a simulation model of the antenna device 100, and FIG. 1C illustrates an equivalent circuit of the antenna device 100. Hereinafter, description will be given by using the XYZ coordinates in common and "in plan view" refers to "in XY plane view".

As illustrated in FIGS. 1A and 1B, the antenna device 100 includes a ground plane 50 and an antenna element 110. The antenna device 100 may be, for example, included in a wireless communication apparatus that performs wireless communication, such as a smartphone terminal device, a tablet computer, or a game machine, or may be mounted on any object or the like so that a network of Internet of Things (IoT) is constructed. The object or the like may be something that is fixed and does not move, such as a wall of a building or the like, or may be something that moves.

The ground plane 50 is a metal layer or a metal plate maintained at a ground potential or a reference potential and may be considered as a ground layer or a ground plate. The ground plane 50 is arranged parallel to the XY plane.

The ground plane 50 may be, for example, a metal layer, a metal plate, or the like included in the wireless communication apparatus mentioned above, or may be a metal layer, a metal plate, or the like mounted on a dedicated substrate, housing, or the like. Such a metal layer, a metal plate, or the like may be something included in a circuit board according to a standard, such as, for example, frame retardant type 4 (FR4).

Of the two surfaces of the ground plane 50, the surface on the positive Z-axis direction side thereof on which the antenna element 110 is disposed is an example of a first surface. In the simulation model, the ground plane 50 is a ground layer infinitely spreads out.

As illustrated in FIG. 1A, the antenna element 110 is disposed to overlap the ground plane 50 in plan view. As illustrated in FIG. 1B, the antenna element 110 includes a feed point 111A, a line 111, a bent portion 111B, a line 112, a bent portion 112A, a line 113, and an end portion 113A.

The antenna element 110 is made of metal and is, for example, implemented by a metal layer of copper foil or the like. The antenna element 110 has a shape in which the antenna element 110 is bent at the bent portion 111B and at the bent portion 112A.

The antenna element 110 is a monopole antenna element in which the length from the feed point 111A to the end portion 113A, that is, the whole length of the antenna element 110, is set to a length corresponding to three-quarters (3λ/4) of the wavelength (electrical length λ) at a resonant frequency f. The resonant frequency is, by way of example, 2.44 GHz. The electrical length λ is the wavelength of an electromagnetic wave that propagates through the antenna element 110.

The feed point 111A is disposed proximate to the ground plane 50. For example, the feed point 111A is disposed at a position that is a predetermined short distance away from the surface on the positive Z-axis direction side of the ground plane 50. The predetermined short distance is, for example, about the thickness of an insulating layer of a substrate disposed between the feed point 111A and the ground plane 50, and is, by way of example, 1 mm. The feed point 111A is coupled via a microstrip line, the core wire of a coaxial cable, or the like to a feeding circuit, such that feeding is performed.

The line 111 includes the feed point 111A and extends in the positive Z-axis direction from the feed point 111A to the bent portion 111B. The length of the line 111 is set to a length less than or equal to three-tenths (0.3λ) of the wavelength (electrical length λ) at the resonant frequency f. The line 111 is an example of a first line.

The bent portion 111B is a portion at which the line 111 extending in the positive Z-axis direction is bent to the positive X-axis direction. The bent portion 111B is an end opposite the feed point 111A of the line 111 and is an example of a first end. The bent portion 111B is a portion for joining the line 111 and the line 112 and may be considered as a joint portion.

This portion, which is referred to as the bent portion 111B herein, is not limited to having a form in which the line 111 and the line 112 are implemented by bending a metal layer, but may have a form in which different lines 111 and 112 are joined by the bent portion 111B. The bent portion 111B may be handled as a joint portion.

The line 112 extends in the X-axis direction from the bent portion 111B to a bent portion 112A. The line 112 is an example of a second line. The line 112 is disposed at a position of a certain height relative to the ground plane 50 between the bent portion 111B and the bent portion 112A.

The bent portion 112A is a portion at which the line 112 extending in the positive X-axis direction is bent to the negative Y-axis direction. The bent portion 112A is also an end opposite the bent portion 111B of the line 112 and is an example of a second end. In addition, the bent portion 112A is a portion for joining the line 112 and the line 113 and may be considered as a joint portion.

This portion, which is referred to as the bent portion 112A herein, is not limited to having a form in which the line 112 and the line 113 are implemented by bending a metal layer, but may have a form in which different lines 112 and 113 are joined by the bent portion 112A.

The line 113 includes the end portion 113A and extends in the Y-axis direction from the bent portion 112A to the end portion 113A. The line 113 is an example of a third line. The line 113 is disposed at a position of a certain height relative to the ground plane 50 between the bent portion 112A and the end portion 113A.

The end portion 113A is an end on the negative Y-axis direction side of the line 113 and is an end opposite the feed point 111A of the antenna element 110. The end portion 113A is an open end and is an example of a third end.

In the antenna element 110 in such a manner, as described above, the length from the feed point 111A to the end portion 113A, that is, the whole length of the antenna element 110, is set to a length corresponding to three-quarters (3λ/4) of the wavelength (electrical length λ) at the resonant frequency f.

The bent portion 112A is formed at a position that enables the vector of a resonant current flowing in the line 112 at the resonant frequency f and the vector of a resonant current flowing in the line 113 at the resonant frequency f to reinforce each other.

Mutual reinforcement of the vector of the resonant current flowing in the line 112 and the vector of the resonant current flowing in the line 113 refers to the fact that the scalar magnitude of a resultant vector obtained by combining the vectors of the resonant currents flowing in the lines 112 and 113 that extend in different directions is greater than the scalar magnitude of either of the two vectors of the resonant currents flowing in the lines 112 and 113.

The bent portion 112A is more preferably disposed at a position corresponding to a node of a resonant current that occurs in the antenna element 110 at a resonant frequency. If the node of the resonant current is positioned at the bent portion 112A, the two vectors of resonant currents flowing in the lines 112 and 113 have a relationship in which these vectors effectively reinforce each other. The position corresponding to the node is not limited to one point of the node of the resonant current but covers positions in front of and behind the node, and is a position at which the two vectors of resonant currents flowing in the lines 112 and 113 have a relationship in which these vectors reinforce each other.

The length from the feed point 111A through the bent portion 111B to the bent portion 112A is set to a length corresponding to the length (0.0698λ to 0.5070λ) that is 0.0698 times to 0.5070 times the wavelength (electrical length λ) at the resonant frequency f. The reason why this length is set to such a length will be described below.

As described above, the length of the line 111 is set to a length corresponding to the length that is three-tenth (0.3λ) or less of the wavelength (electrical length λ) at the resonant frequency f. The reason why the length is set to such a length will be described below.

By way of example, a form in which the length of the line 111 (the length from the feed point 111A to the bent portion 111B) is 0.024λ and the length from the feed point 111A through the bent portion 111B to the bent portion 112A is 0.276λ will be described.

In this case, the length of the line 112 (the length from the bent portion 111B to the bent portion 112A) is 0.252λ and the length of the line 113 (the length from the bent portion 112A to the end portion 113A) is 0.496λ.

The reason why the lengths are set to such values will be described below. The length corresponding to three-quarters (3λ/4) of the wavelength (electrical length λ) at the resonant frequency f is not limited exactly to 3λ/4 but is meant to include a length slightly shifted from 3λ/4 in consideration of the permittivities and the like of the neighboring components.

The length corresponding to the length less than or equal to three-tenth (0.3λ) of the wavelength (electrical length λ) is not limited exactly to 0.3λ but is meant to include a length less than or equal to a length slightly shifted from 0.3λ in consideration of the permittivities and the like of the neighboring components.

The length corresponding to a length (0.0698λ to 0.5070λ) that is 0.0698 times to 0.5070 times the wavelength (electrical length λ) at the resonant frequency f is not limited exactly to a range of 0.0698λ to 0.5070λ but is meant to include a length included in a range slightly shifted from the range of 0.0698λ to 0.5070λ in consideration of the permittivities and the like of the neighboring components.

The equivalent circuit of the antenna element 110 in such a manner is, as illustrated in FIG. 1C, a circuit extending from the feed point 111A to the bent portion 112A on the XZ plane. The line 113 extends from the bent portion 112A to the end portion 113A in the negative Y-axis direction.

Figure 2:
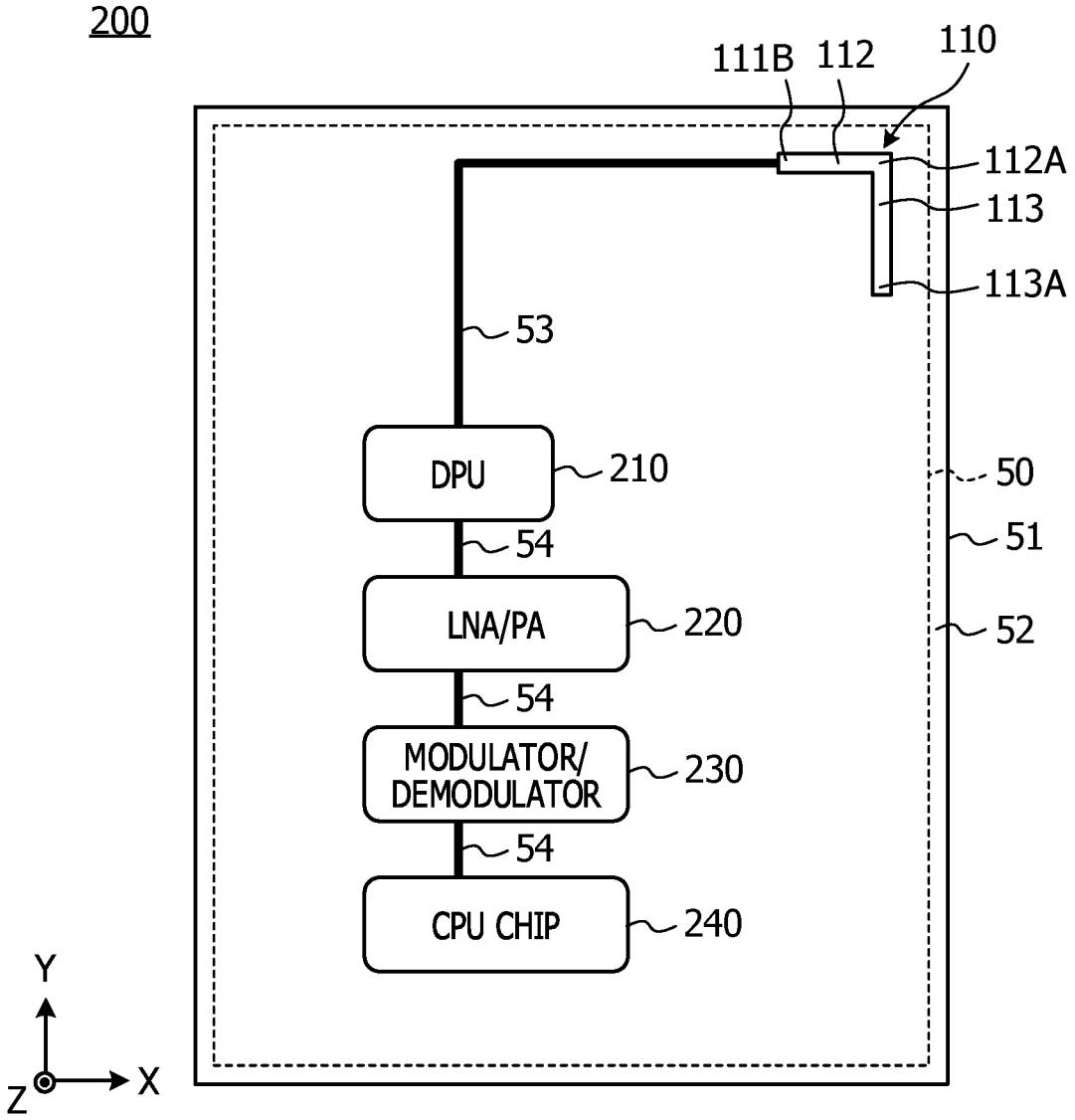
FIG. 2 is a diagram illustrating a wireless communication apparatus including an antenna device according to an embodiment.

FIG. 2 is a diagram illustrating a configuration of a wireless communication apparatus 200 including the antenna device 100. FIG. 2 illustrates a configuration of the wireless communication apparatus 200 as viewed in plan. The wireless communication apparatus 200 illustrated in FIG. 2 is, by way of example, included in a smartphone terminal device.

The wireless communication apparatus 200 includes a substrate 51, an antenna element 110, a duplexer (DUP) 210, a low noise amplifier (LNA)/power amplifier (PA) 220, a modulator/demodulator 230, and a central processing unit (CPU) chip 240.

The substrate 51, which is, by way of example, an FR4 standard circuit board, includes the ground plane 50, an insulating layer 52, a microstrip line 53, and wiring 54. The ground plane 50 is disposed on the surface on the negative Z-axis direction side of the insulating layer 52, and the microstrip line 53 and the wiring 54 are disposed on the surface on the positive Z-axis direction side of the insulating layer 52. On the surface on the positive Z-axis direction side of the insulating layer 52, the DUP 210, the LNA/PA 220, the modulator/demodulator 230, and the CPU chip 240 are also mounted.

The ground plane 50 is rectangular in plan view and is disposed over the substantial entirety of the insulating layer 52 that is also rectangular in plan view. The antenna element 110 is disposed on the negative Z-axis direction side of the insulating layer 52 so as to be positioned at the corner on the positive X-axis direction side and on the positive Y-axis direction side of the ground plane 50 in plan view.

The microstrip line 53 has a characteristic impedance (for example, 50Ω) that matches the impedance of the antenna element 110, and transmits a signal under low-loss and low-reflection conditions between the antenna element 110 and the DUP 210. Although the form of performing feeding via the microstrip line 53 is described herein by way of example, any of the transmission paths having a characteristic impedance that matches that of the antenna element 110 may be used other than the microstrip line 53.

The antenna element 110 has a height due to the line 111 (refer to FIG. 1B), and therefore an insulator having a height equal to the height due to the line 111 is disposed on the surface on the positive Z-axis direction side of the insulating layer 52, such that the antenna element 110 is held by the insulator. The antenna device 100 is constructed of the antenna element 110 and the ground plane 50.

Instead of such a configuration, a configuration in which the antenna element 110 is held by a member mounted on the positive Z-axis direction side of the insulating layer 52 may be employed. Such a member is, for example, a housing or the like of a wireless communication apparatus including the antenna device 100.

The DUP 210, the LNA/PA 220, the modulator/demodulator 230, and the CPU chip 240 are coupled via the wiring 54.

The DUP 210, which is coupled via the microstrip line 53 and a via (not illustrated) to the antenna element 110, switches between transmission and reception functions. The DUP 210 has filter capabilities, and therefore when the antenna element 110 receives signals of a plurality of frequencies, the DUP 210 is able to separate the signals of the respective frequencies inside of itself.

The LNA/PA 220 amplifies the power of both transmission waves and received waves. The modulator/demodulator 230 modulates transmission waves and demodulates received waves. The CPU chip 240 has the function of a communication processor that performs communication processing of the wireless communication apparatus 200 and the function of an application processor that executes application programs. The CPU chip 240 includes an inner memory for storing data to be transmitted, data that has been received, and the like. The LNA/PA 220, the modulator/demodulator 230, and the CPU chip 240 are an example of a feeding circuit.

The microstrip line 53 and the wiring 54 are formed, for example, by patterning copper foil on the surface of the insulating layer 52. Although not illustrated in FIG. 2, a matching circuit for adjusting the impedance characteristic is formed between the antenna device 100 and the DUP 210.

Figure 3A:
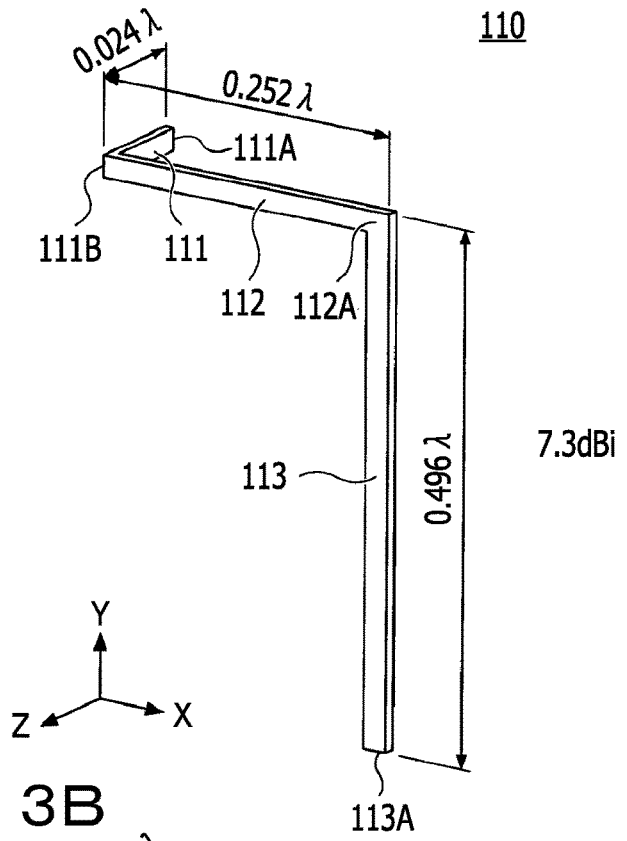
FIGS. 3A to 3C are diagrams illustrating an antenna element according to an embodiment and antenna elements for comparison.
Figure 3B:
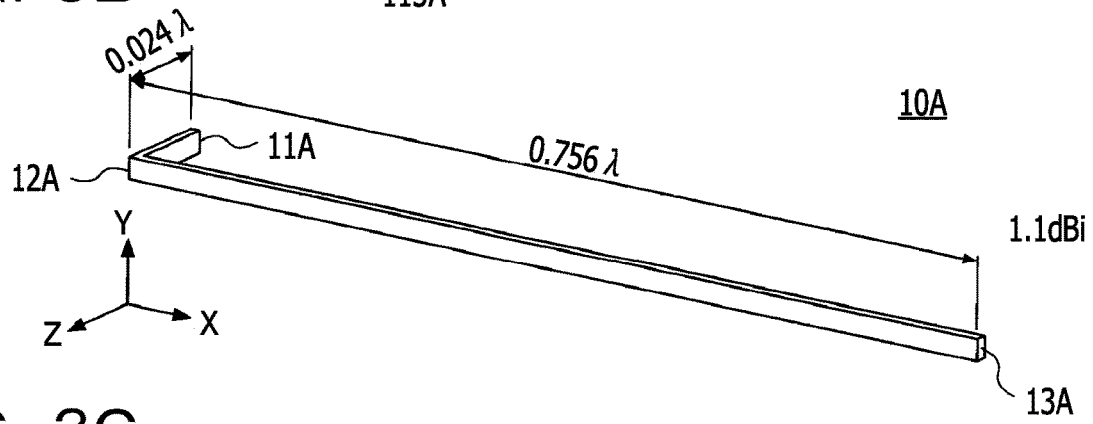
Figure 3C:
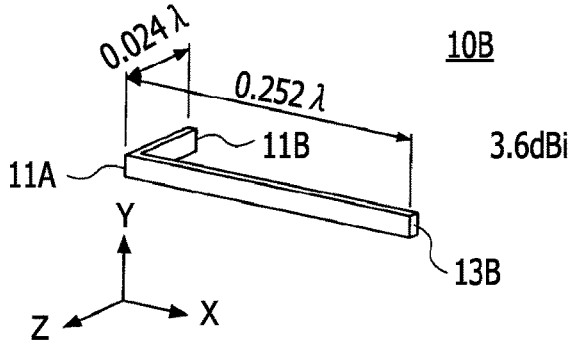

FIGS. 3A to 3C are diagrams illustrating the antenna element 110 according to the embodiment and antenna elements 10A and 10B for comparison. FIGS. 3A to 3C also illustrate gains in the vertical direction determined by electromagnetic field simulation. The vertical direction is the positive Z-axis direction and is a direction vertical to the ground plane 50. The vertical direction may be handled as the front direction of the antenna device 100.

Although the ground plane 50 is not illustrated in FIGS. 3A to 3C, electromagnetic field simulation is performed assuming that the ground plane 50 is present in the cases of FIGS. 3A to 3C, as in the case of FIG. 1A.

The antenna element 110 according to the embodiment illustrated in FIG. 3A is the same as illustrated in FIG. 1B such that the lengths of the lines 111, 112, and 113 are 0.024λ, 0.252λ, and 0.496λ, respectively.

The antenna element 10A for comparison illustrated in FIG. 3B has a configuration in which the line 113 of the antenna element 110 extends straightly without being bent relative to the line 112. For example, the antenna element 10A extends in the positive Z-axis direction from a feed point 11A and is bent at a bent portion 12A into the positive X-axis direction to extend to an end portion 13A. The antenna element 10A, which is an antenna element for a modified type of a monopole antenna, is reversed L-shaped and has a length of 3λ/4.

The length from the feed point 11A to the bent portion 12A is 0.024λ, which is the same as the length of the line 111 of the antenna element 110. That is, the height of the antenna element 10A relative to the ground plane 50 is equal to the height of the antenna element 110 relative to the ground plane 50. The length from the bent portion 12A to the end portion 13A is 0.756λ, and the length from the feed point 11A to the end portion 13A is a length corresponding to three-quarters (3λ/4) of the wavelength (electrical length λ) at the resonant frequency f.

The antenna element 10B for comparison illustrated in FIG. 3C is an element having a length obtained by reducing the length of the antenna element 10A illustrated in FIG. 3B to a quarter (λ/4) of the wavelength (electrical length λ) at the resonant frequency f. For example, the antenna element 10B extends in the positive Z-axis direction from a feed point 11B and is bent at a bent portion 12B into the positive X-axis direction to extend to an end portion 13B. The antenna element 10B is a reversed L-shaped monopole antenna.

The length from the feed point 11B to the bent portion 12B is 0.024λ, which is the same as the length of the line 111 of the antenna element 110. That is, the height of the antenna element 10B relative to the ground plane 50 is equal to the height of the antenna element 110 relative to the ground plane 50. The length from the bent portion 12B to the end portion 13B is 0.252λ.

As indicated in FIG. 3A, the gain in the vertical direction of the antenna element 110 is 7.3 dBi; as indicated in FIG. 3B, the gain in the vertical direction of the antenna element 10A is 1.1 dBi; and, as indicated in FIG. 3C, the gain in the vertical direction of the antenna element 10B is 3.6 dBi.

From the above, the gain in the vertical direction of the antenna element 110 is about double the gain in the vertical direction of the reversed L-shaped antenna element 10B having a length of λ/4. In contrast, the gain in the vertical direction of the antenna element 10A that is reversed L-shaped and has a length of 3λ/4 is about one-seventh of the gain in the vertical direction of the antenna element 110 and is about one-third of the gain in the vertical direction of the antenna element 10B.

Figure 4A:
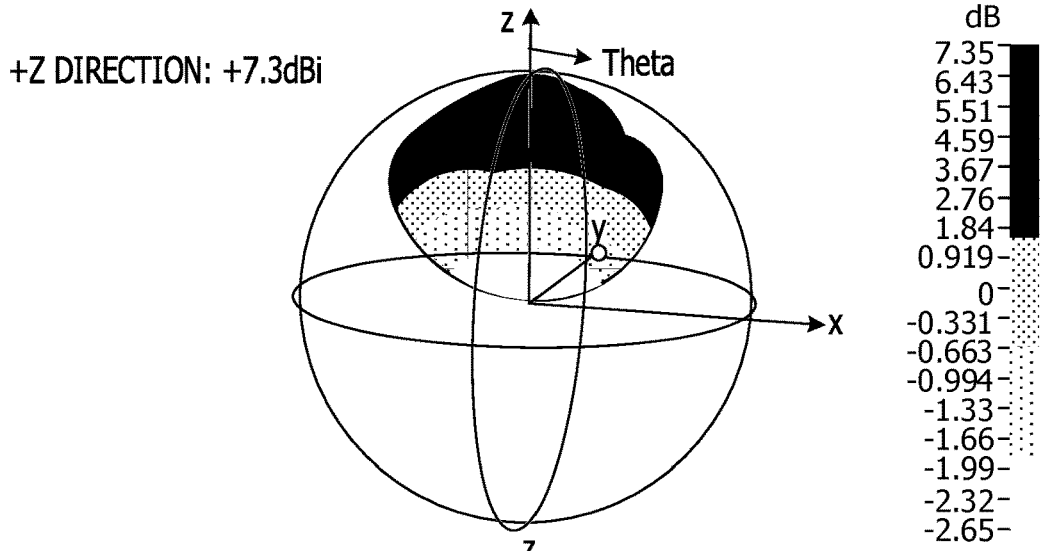
FIGS. 4A to 4C are diagrams illustrating radiation patterns of an antenna element according to an embodiment and antenna elements for comparison.
Figure 4B:
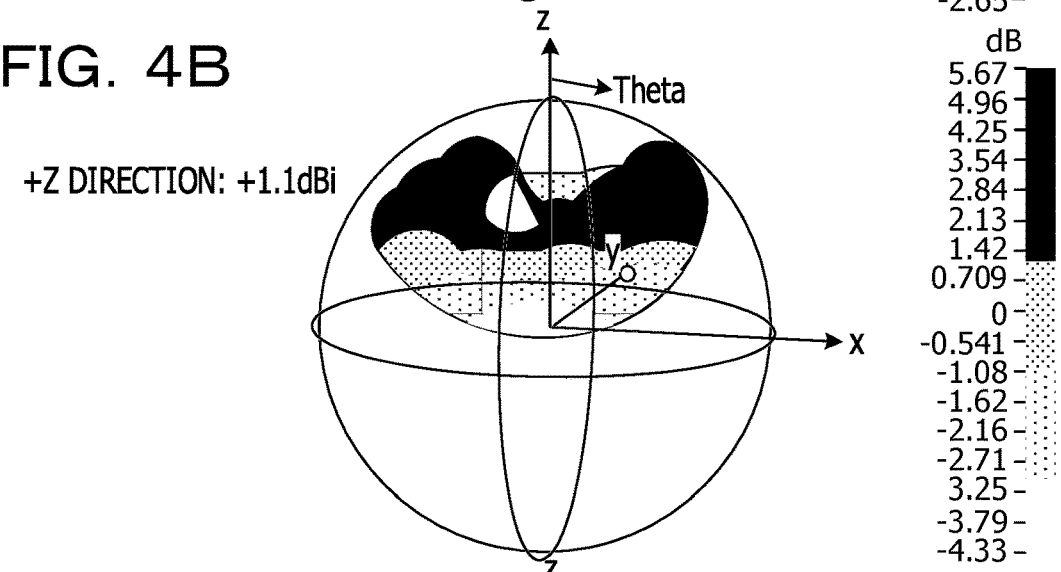
Figure 4C:
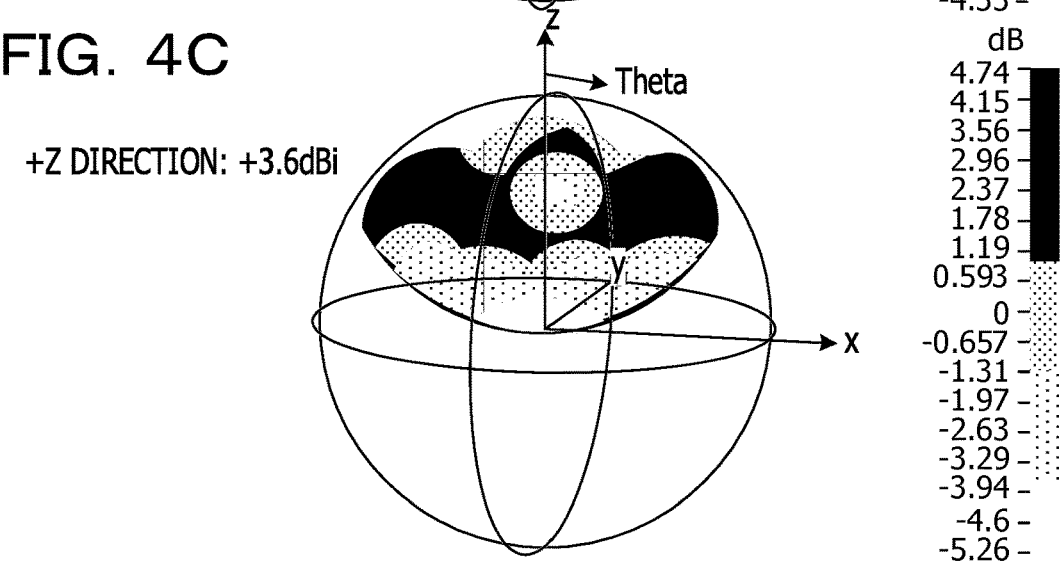

FIGS. 4A to 4C are diagrams illustrating radiation patterns of the antenna elements 110, 10A, and 10B. The XYZ coordinates in FIGS. 4A to 4C are equal to the XYZ coordinates illustrated in FIGS. 1A to 3C. In FIGS. 4A to 4C, the antenna elements 110, 10A, and 10B are each disposed at the origin of the XYZ coordinates.

As illustrated in FIG. 4A, the radiation pattern of the antenna element 110 is oriented in the vertical direction (positive Z-axis direction), and a large gain of +7.3 dBi is obtained.

As illustrated in FIG. 4B, the radiation pattern of the antenna element 10A has a large depression in the vertical direction (positive Z-axis direction) and has a gain of +1.1 dB, which is a very small value.

As illustrated in FIG. 4C, the radiation pattern of the antenna element 10B is oriented in the vertical direction (positive Z-axis direction) and the gain thereof is about half (+3.6 dBi) the gain of the antenna element 110.

Figure 5A:
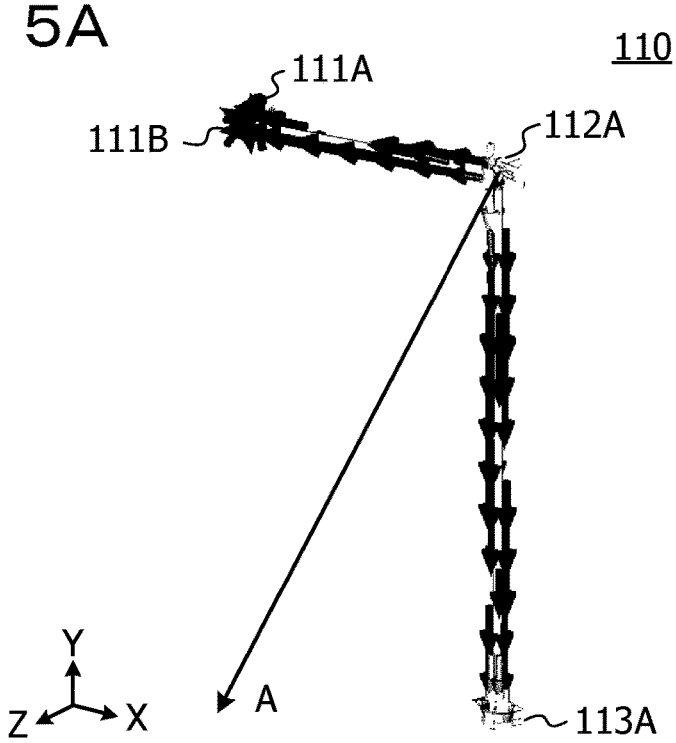
FIGS. 5A to 5C are diagrams illustrating current distributions of an antenna element according to an embodiment and antenna elements for comparison.
Figure 5B:
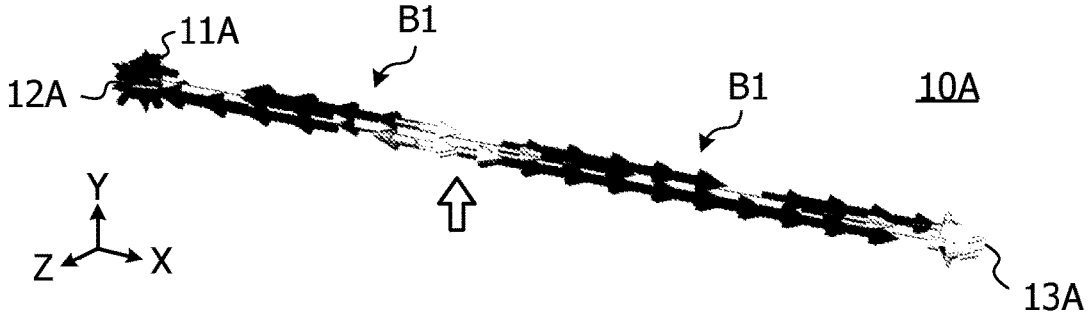
Figure 5C:
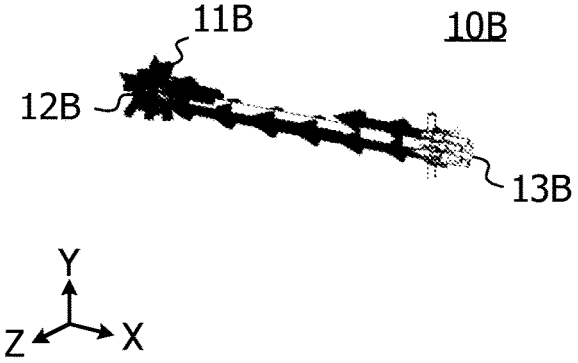

FIGS. 5A to 5C are diagrams illustrating current distributions of the antenna elements 110, 10A, and 10B. The current distributions indicated by arrows in FIGS. 5A to 5C are obtained by electromagnetic field simulation. The arrow direction indicates a direction in which a resonant current flows at some instance, and the current distribution illustrated in grayscale indicates that the darker the color of an arrow, the higher the current density whereas the lighter the color of an arrow, the lower the current density.

As illustrated in FIG. 5A, for the current distribution of the antenna element 110, it is recognized that the current density is highest at the feed portion 111A and at an intermediate portion between the bent portion 112A and the end portion 113A and is lowest at the bent portion 112A and at the end portion 113A.

Since the antenna element 110 has a length of 3λ/4, antinodes of the resonant current are at the feed point 111A and at an intermediate portion between the bent portion 112A and the end portion 113A and nodes of the resonant current are at the bent portion 112A and at the end portion 113A.

As illustrated in FIG. 5B, since the antenna element 10A has a length of 3λ/4, in the current distribution, nodes of the resonant current are at a position λ/4 away from the feed point 11A and at the end portion 13A and antinodes of the resonant current are at the feed point 11A and at a position λ/2 away from the feed point 11A.

As illustrated in FIG. 5C, since the antenna element 10B has a length of λ/4, in the current distribution, a node of the resonant current is at the end portion 13B and an antinode of the resonant current is at the feed point 11B.

From the current distributions of the antenna elements 110, 10A, and 10B as described above, respective gains thereof will be discussed. The antenna element 10B is an exemplary quarter-wavelength (λ/4) monopole antenna, and the gain of the antenna element 10B may be used as a determination criterion.

For the antenna element 10A, it is considered that resonant currents oriented opposite to each other, which are indicated by arrows B1 and B2, occur on both sides of the node and thereby the radiation is cancelled out. It is also considered that the cancellation of radiation causes the gain to be lower than the gain of the antenna element 10B.

In the antenna element 110, the bent portion 112A is a node of the resonant current, and a resonant current from the bent portion 112A toward the bent portion 111B and a resonant current from the bent portion 112A toward the end portion 113A differ in direction.

The reason why, in the antenna element 110 in such a configuration, a gain greater than the gain in the antenna element 10B is obtained is as follows. A resultant vector (vector indicated by an arrow A) obtained by combining the vector of the resonant current from the bent portion 112A toward the bent portion 111B and the vector of the resonant current from the bent portion 112A toward the end portion 113A is greater than the vector of the resonant current of the antenna element 10B, so that a gain about double the gain of the antenna element 10B is obtained. The vector of the resonant current of the antenna element 10B is a current vector obtained midway between the end portion 13B and the bent portion 12B.

Figure 6:
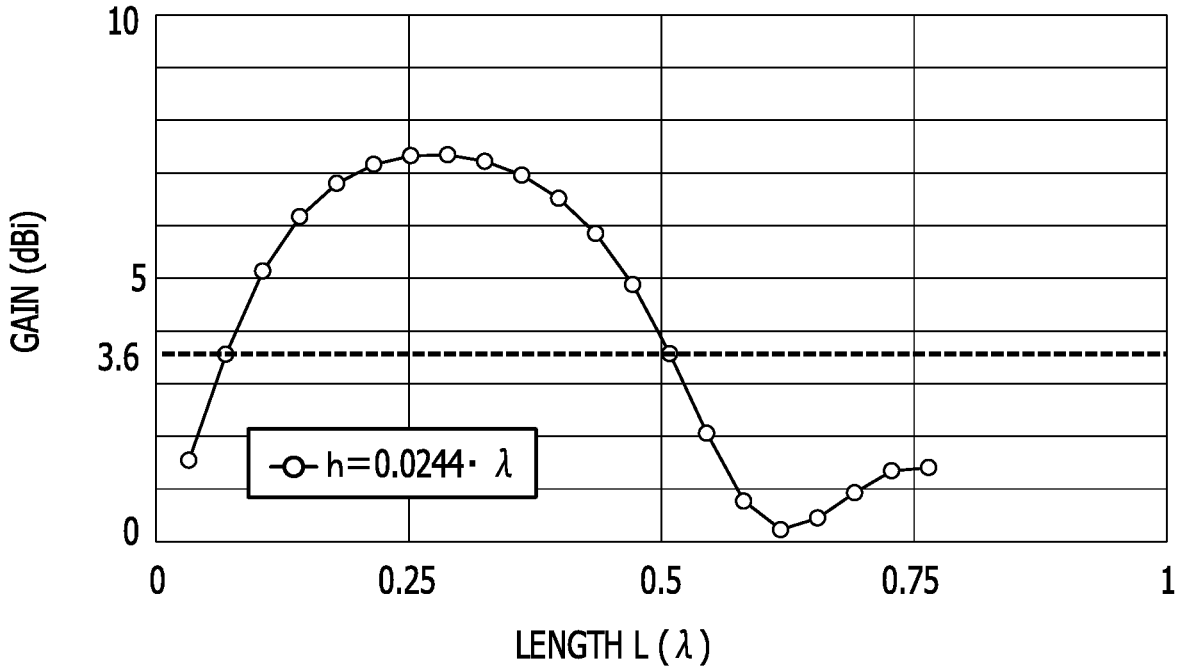
FIG. 6 is a diagram illustrating gain characteristics relative to a length in a simulation model of an antenna device according to an embodiment.

FIG. 6 is a diagram illustrating the gain in a simulation model of the antenna device 100 when a length L from the feed point 111A to the bent portion 112A is varied. The gain is a gain in the vertical direction (positive Z-axis direction). The length L is represented by a normalized value obtained by division by the wavelength (electrical length λ) at the resonant frequency f.

The length of the line 111 is fixed to 0.024λ and the length of the antenna element 110 is substantially fixed at 3λ/4. The length of the antenna element 110 is not fixed at 3λ/4 but is substantially fixed at 3λ/4 because as the length L varies, the length of the antenna element 110 may vary to some extent due to impedance adjustment or the like.

When the length L is varied from 0.024λ to about 0.76λ, the gain is about 7.3 dBi at the length L of about 0.25λ. Assuming that the gain (3.6 dBi) of the antenna element 10B is a determination criterion, the gain is 3.6 dBi or more with the length L within a range of 0.0698λ to 0.5070λ.

Therefore, it has been found that setting the length L to be within a range of 0.0698λ to 0.5070λ yields a gain greater than or equal to the gain of the antenna element 10B having a length of a quarter wavelength (λ/4). With the length L of 0.024λ, there is formed an antenna element in a configuration in which the line 112 is not formed and the line 113 is directly joined to the line 111.

Figure 7:
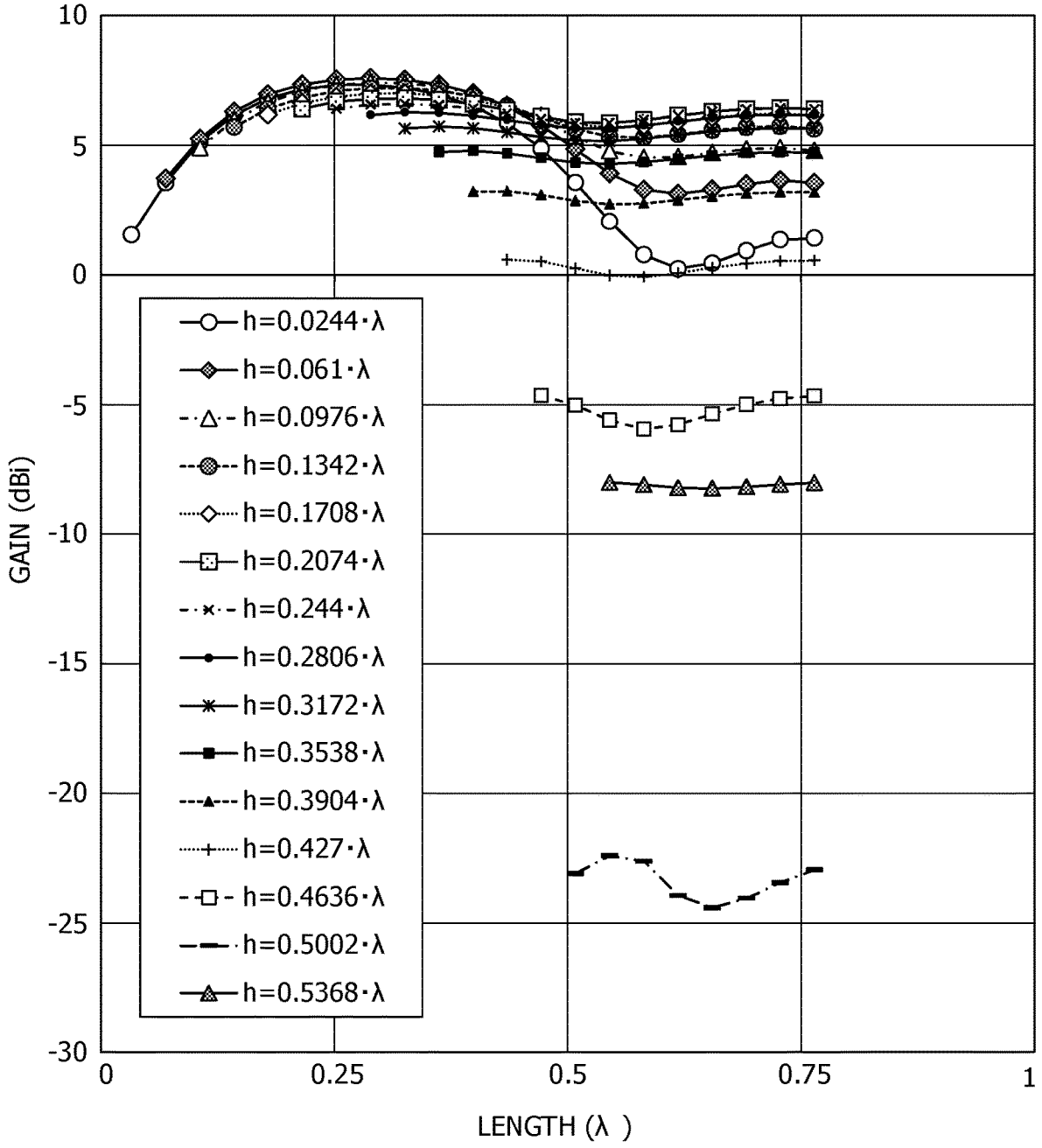
FIG. 7 is a diagram illustrating gain characteristics relative to a height and a length in a simulation model of an antenna device according to an embodiment.

FIG. 7 is a diagram illustrating relationships between the length L and the gain in a simulation model of the antenna device 100 when the height h from the feed point 111A to the bent portion 111B is changed. The gain is a gain in the vertical direction (positive Z-axis direction). The length L, as in FIG. 6, is a length from the feed point 111A to the bent portion 112A and is represented by a normalized value obtained by division by the wave length (electrical length λ) at the resonant frequency f. The length of the antenna element 110 is substantially fixed at 3λ/4. Substantially fixing the length of the antenna element 110 at 3λ/4 has a meaning similar to that described with reference to FIG. 6.

The characteristics illustrated in FIG. 7 are obtained by varying the length L from 0.024λ to about 0.76λ and varying the height h. The height h is set to 0.0244λ, 0.061λ, 0.0976λ, 0.1342λ, 0.1708λ, 0.2074λ, 0.244λ, 0.2806λ, 0.3172λ, 0.3538λ, 0.3904λ, 0.427λ, 0.4636λ, 0.5002λ, and 0.5368λ.

Figure 8:
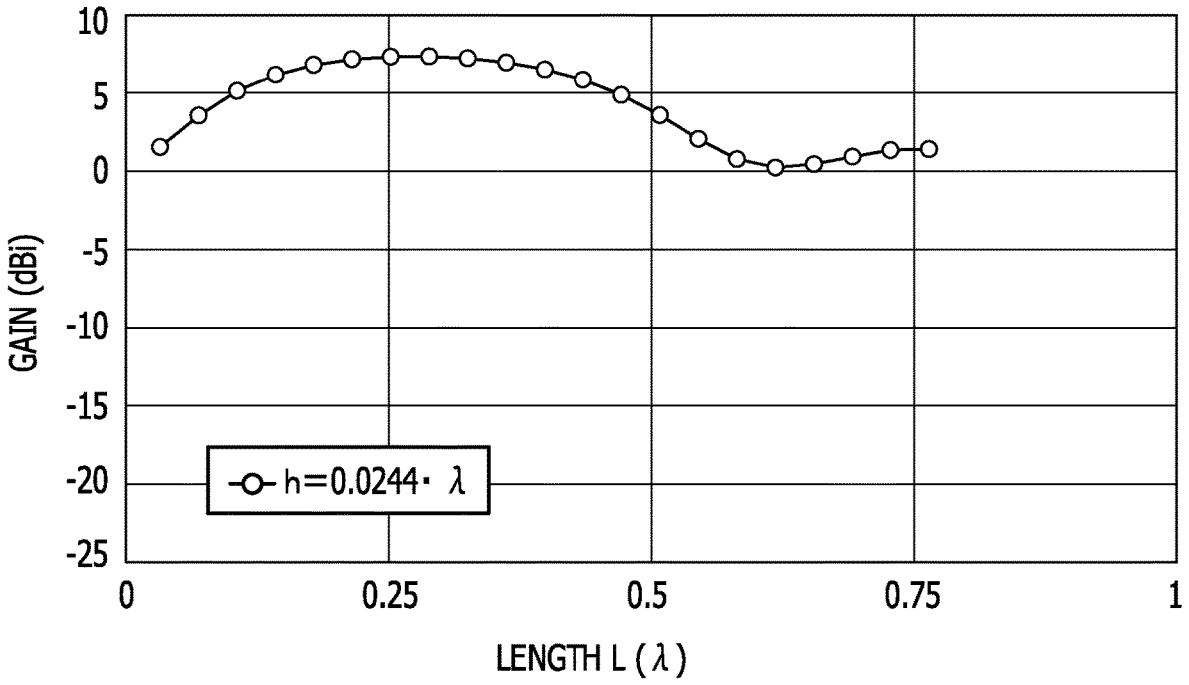
FIG. 8 is a diagram illustrating gain characteristics relative to a length for a height of 0.0244λ.

FIG. 8 is a diagram illustrating the characteristics with the height h of 0.0244λ, which are selected from the characteristics illustrated in FIG. 7.

As illustrated in FIG. 7, for the height h of 0.5002λ, the gain has low values of about −23 dBi to about −24 dBi. This is considered because a node of a resonant current is positioned about 0.25λ away from the feed point 111A and therefore the node of the resonant current is at an intermediate portion of the line 111, cancelling out the radiation. It is considered that, for the heights h of 0.4636λ and 0.5386λ, similar phenomena occur, resulting in gains of about −5 dBi and about −8 dBi, respectively.

It is also considered that, for the height h of 0.427λ, the radiation is cancelled out by resonant currents in opposite directions flowing in the line 111, such that the gain is about 0 dBi.

For the heights h of 0.3172λ, 0.3538λ, and 0.3904λ, the gain is about 5 dBi to about 5.5 dBi, about 4.5 dBi to about 5 dBi, and about 3 dBi, respectively.

For the heights h of 0.0244λ, 0.061λ, 0.976λ, 0.1342λ, 0.1708λ, 0.2074λ, 0.244λ, and 0.2806λ, it has been found that a high gain of about 7 dBi or more is obtained when the length L is in the neighborhood of about 0.3λ.

As illustrated in FIG. 8, for the height h of 0.0244λ, when the length L is varied, the gain varies within a range of about 2 dBi to 7.3 dBi, and the length L to yield the greatest gain (7.3 dBi) is about 0.25λ.

Figure 9:
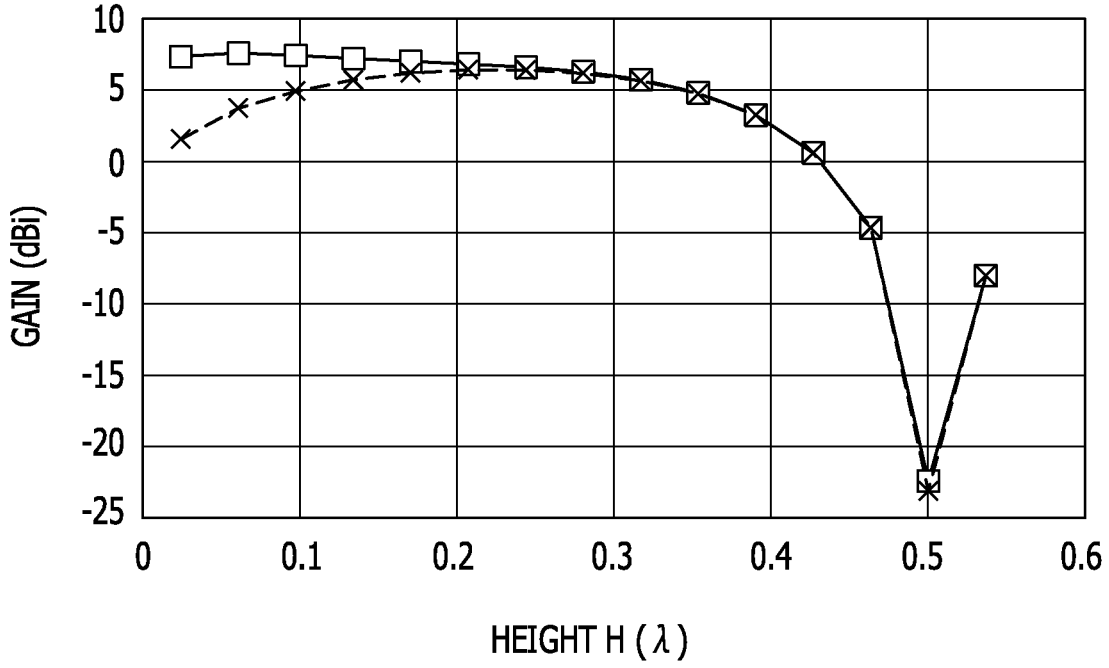
FIG. 9 is a diagram illustrating the relationship between a height and a gain of an antenna element according to an embodiment.

FIG. 9 is a diagram illustrating a relationship between the height h and the gain in the antenna element 110. The gain indicated by an X-shaped marker in FIG. 9 is the greatest gain obtained by varying the length L for each of the cases where the height h is 0.0244λ, where the height h is 0.061λ, where the height h is 0.976λ, where the height h is 0.1342λ, where the height h is 0.1708λ, where the height h is 0.2074λ, where the height h is 0.244λ, where the height h is 0.2806λ, where the height h is 0.3172λ, where the height h is 0.3538λ, where the height h is 0.3904λ, where the height h is 0.427λ, where the height h is 0.4636λ, where the height h is 0.5002λ, and where the height h is 0.5368λ. That is, the greatest gain obtained when the height h is 0.0244λ is a value obtained when the length L is about 0.25λ, and the greatest gain obtained when the height h is 0.5368λ is a value obtained when the length L is about 0.54λ.

In FIG. 9, for comparison, the gain characteristics obtained when, in the antenna element 10A (refer to FIG. 5B), the height h (the length from the feed point 11A to the bent portion 12A) is varied are indicated by square markers. With reference to FIG. 9, it has been found that when the height h is less than or equal to 0.3λ, the gain of the antenna element 110 is 0.1 dBi or more greater than the gain of the antenna element 10A.

As described above, according to the embodiment, the bent portion 112A of the antenna element 110 whose whole length is three-quarters of the wavelength (electrical length λ) at the resonant frequency f is disposed at a position at which the vector of a current flowing in the line 112 and the vector of a current flowing in the line 113 have a relationship in which the vectors reinforce each other. Therefore, the antenna device 100 having a high gain may be formed.

Accordingly, the antenna device 100, which has a sufficient communication distance in a direction vertical to the ground plane, and the wireless communication apparatus 200 may be provided.

For example, since the bent portion 112A is at a position corresponding to a node of the resonant current, a resultant vector obtained by combining the vector of a current flowing in the line 112 and the vector of a current flowing in the line 113 is greater than the vector of the resonant current in the antenna element 10B (refer to FIG. 3C) for comparison whose whole length is λ/4. Thus, the antenna device 100 having a high gain may be provided.

In addition, by setting the length from the feed point 111A to the bent portion 112A to a length corresponding to the length that is 0.0698 times to 0.5070 times the electrical length λ, a gain greater than or equal to the gain of the antenna element 10B for comparison (refer to FIG. 3C) whose whole length is λ/4 may be obtained.

In addition, by setting the length from the feed point 111A to the bent portion 111B (the height h relative to the ground plane 50) to be less than or equal to 0.3λ, the antenna device 100 having a gain that is 0.1 dBi or more greater than the reverse L-shaped antenna element 10A (refer to FIG. 3B) whose whole length is three-quarters of the electrical length λ may be provided.

In the above, the form of the antenna element 110 in which the line 113 is bent at right angles to the line 112, in plan view, has been described; however, the angle of the line 113 relative to the line 112, in plan view, may not be vertical. The angle of the line 113 relative to the line 112, in plan view, may be an angle at which a resultant vector that allows the vector of a current flowing in the line 112 and the vector of a current flowing in the line 113 to reinforce each other is obtained and at which the resultant vector greater than the vector of the resonant current in the antenna element 10B (refer to FIG. 3C) is obtained.

In addition, although the form in which the lines 111, 112, and 113 are linear has been described above, the lines 111, 112, and 113 may be shaped in ways other than so as to be linear. FIGS. 10A to 10C and FIGS. 11A to 11D are diagrams illustrating antenna elements 110M1 to 110M7 according to modifications of the embodiment.

The antenna elements 110M1 to 110M7 are antenna elements in which the shape of at least one of the lines 111, 112, and 113 of the antenna element 110 is deformed into a meander shape. The conditions such as the lengths of the lines 111, 112, and 113 are similar to the conditions for the antenna element 110 described with reference to FIG. 1 to FIG. 9, and therefore the shapes and the like of the lines of the antenna elements 110M1 to 110M7 will be described here.

Figure 10A:
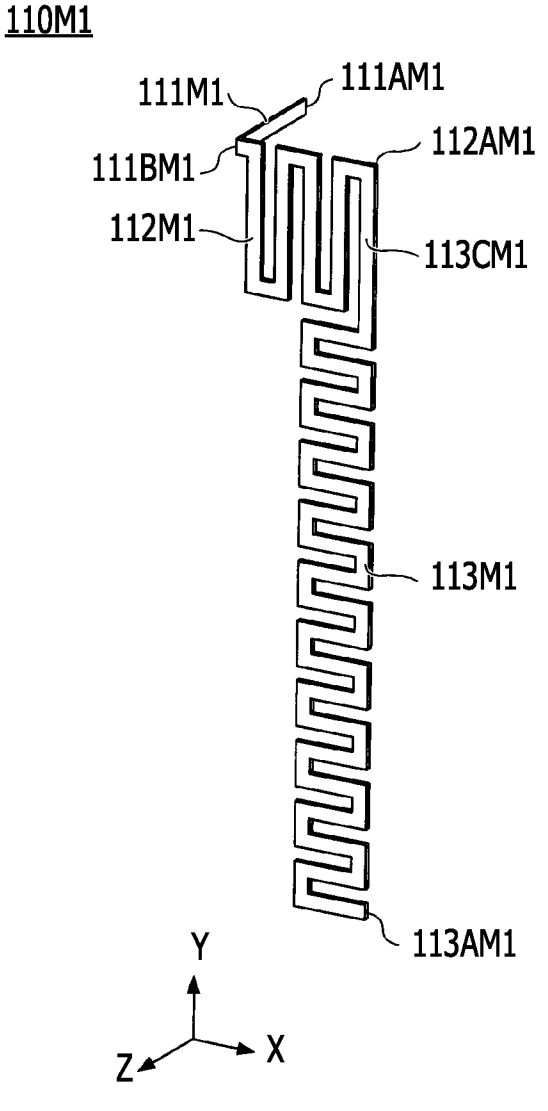
FIGS. 10A to 10C are diagrams respectively illustrating antenna elements of modifications of an embodiment.

The antenna element 110M1 illustrated in FIG. 10A includes lines 111M1, 112M1, and 113M1. The line 111M1 extends linearly from a feed point 111AM1 to a bent portion 111BM1, the line 112M1 extends in a meander shape from the bent portion 111BM1 to a bent portion 112AM1, and the line 113M1 extends from the bent portion 112AM1 toward an end portion 113AM1 such that, after passing through a linear portion 113CM1, the line 113M1 extends in a meander shape.

Figure 10B:
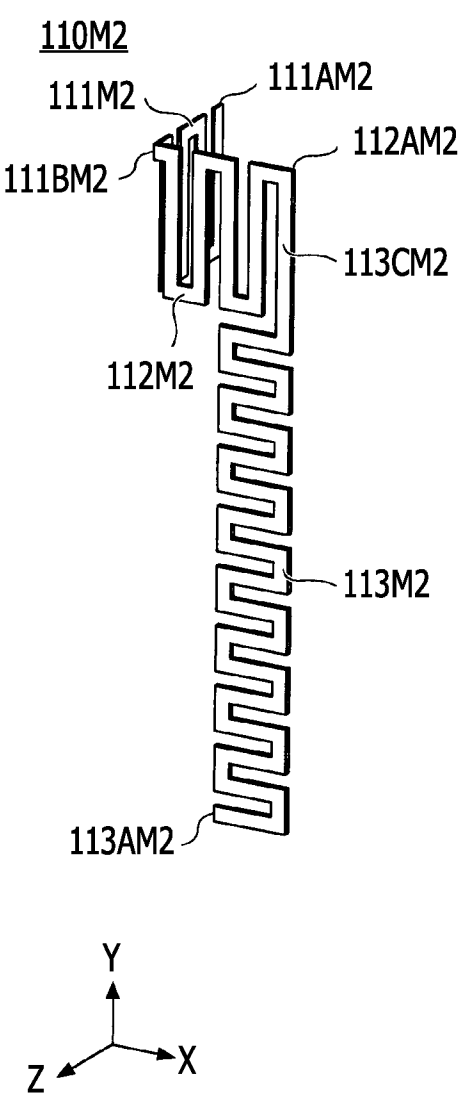

The antenna element 110M2 illustrated in FIG. 10B includes lines 111M2, 112M2, and 113M2. The line 111M2 extends in a meander shape from a feed point 111AM2 to a bent portion 111BM2, the line 112M2 extends in a meander shape from the bent portion 111BM2 to a bent portion 112AM2, and the line 113M2 extends from the bent portion 112AM2 toward an end portion 113AM2 such that, after passing through a linear portion 113CM2, the line 113M2 extends in a meander shape.

Figure 10C:
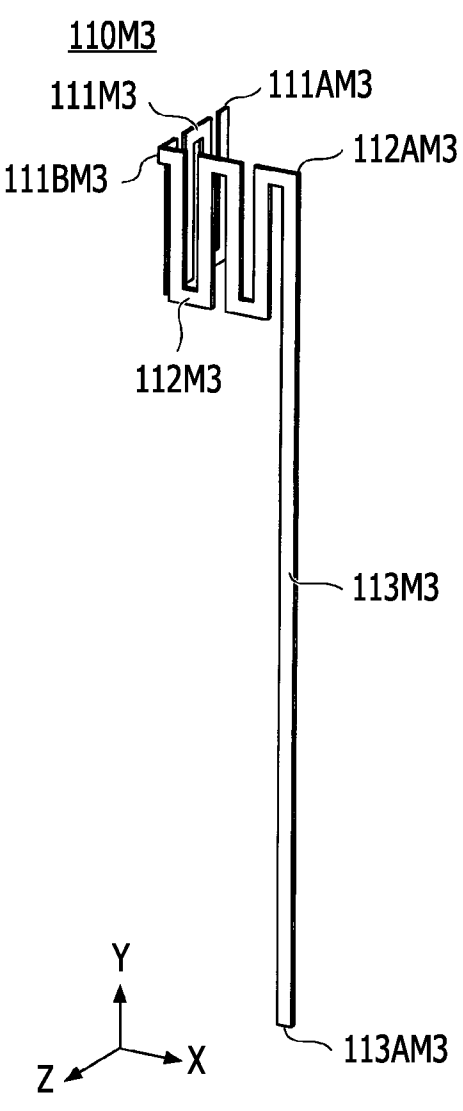

The antenna element 110M3 illustrated in FIG. 10C includes lines 111M3, 112M3, and 113M3. The line 111M3 extends in a meander shape from a feed point 111AM3 to a bent portion 111BM3, the line 112M3 extends in a meander shape from the bent portion 111BM3 to a bent portion 112AM3, and the line 113M3 extends linearly from the bent portion 112AM3 toward an end portion 113AM3.

Figures 11A, 11B, 11C, 11D:
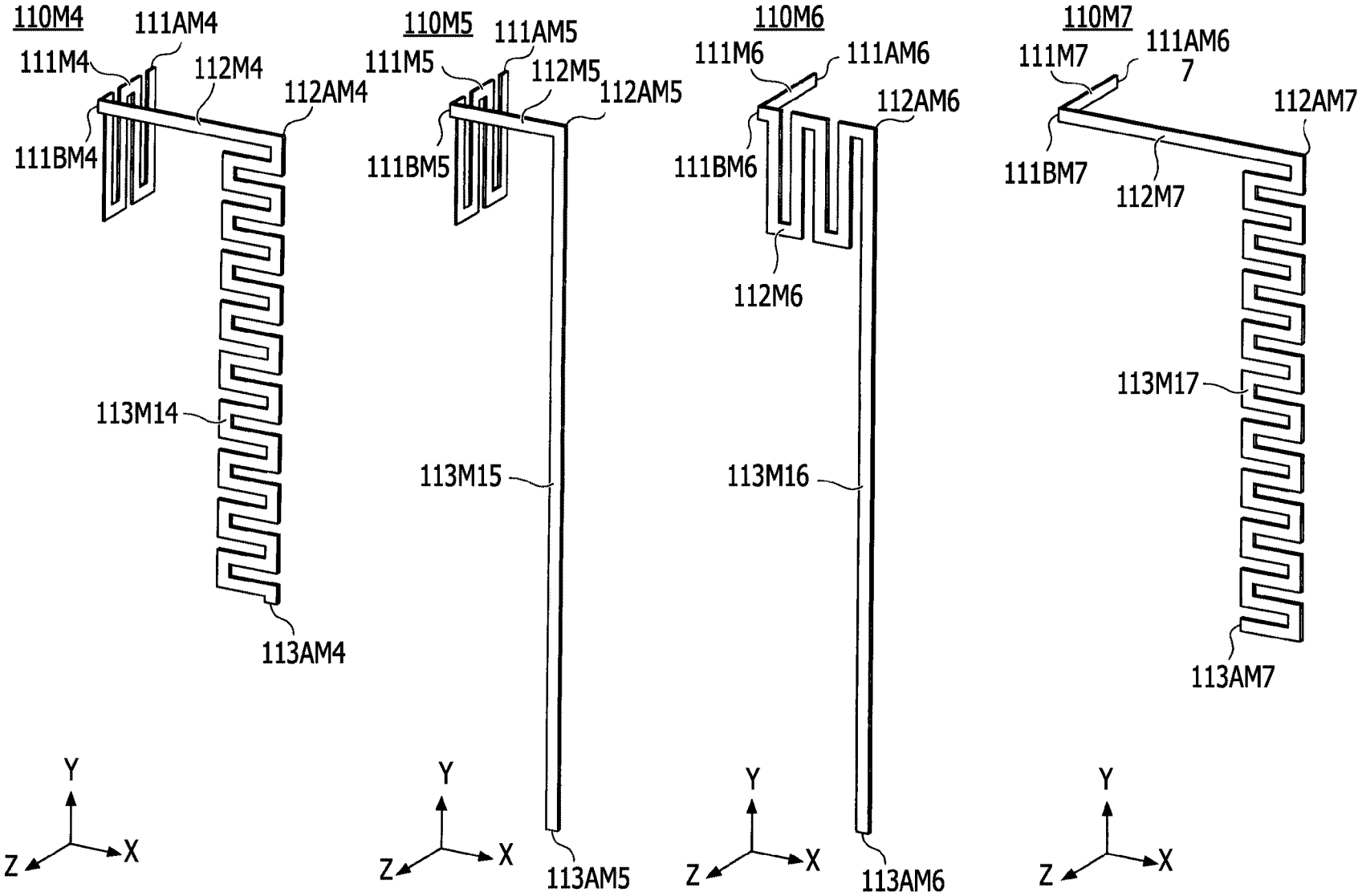
FIGS. 11A to 11D are diagrams respectively illustrating antenna elements of modifications of an embodiment.

The antenna element 110M4 illustrated in FIG. 11A includes lines 111M4, 112M4, and 113M4. The line 111M4 extends in a meander shape from a feed point 111AM4 to a bent portion 111BM4, the line 112M4 extends linearly from the bent portion 111BM4 to a bent portion 112AM4, and the line 113M4 extends in a meander shape from the bent portion 112AM4 toward an end portion 113AM4.

The antenna element 110M5 illustrated in FIG. 11B includes lines 111M5, 112M5, and 113M5. The line 111M5 extends in a meander shape from a feed point 111AM5 to a bent portion 111BM5, the line 112M5 extends linearly from the bent portion 111BM5 to a bent portion 112AM5, and the line 113M5 extends linearly from the bent portion 112AM5 toward an end portion 113AM5.

The antenna element 110M6 illustrated in FIG. 11C includes lines 111M6, 112M6, and 113M6. The line 111M6 extends linearly from a feed point 111AM6 to a bent portion 111BM6, the line 112M6 extends in a meander shape from the bent portion 111BM6 to a bent portion 112AM6, and the line 113M6 extends linearly from the bent portion 112AM6 toward an end portion 113AM6.

The antenna element 110M7 illustrated in FIG. 11D includes lines 111M7, 112M7, and 113M7. The line 111M7 extends linearly from a feed point 111AM7 to a bent portion 111BM7, the line 112M7 extends linearly from the bent portion 111BM7 to a bent portion 112AM7, and the line 113M7 extends in a meander shape from the bent portion 112AM7 toward an end portion 113AM7.

In the antenna elements 110M1 to 110M7 as described above, the vectors (in the X-axis direction) of resonant currents flowing in the lines 112M1 to 112M7 and the vectors (in the Y-axis direction) of resonant currents flowing in the lines 113M1 to 113M7 reinforce each other, and therefore antenna devices having high gains may be provided, as in the case using the antenna element 110 described with reference to FIG. 1A to FIG. 9.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. An antenna device comprising:

a ground plane; and an antenna element formed on a first surface of the ground plane, the antenna element including a feed point, a first line extending from the feed point to a first end entirely in a direction away from the first surface, a second line extending along the first surface of the ground plane from the first end of the first line to a second end, and a third line extending along the first surface of the ground plane from the second end of the second line to a third end in a direction different in plan view from an extending direction of the second line, wherein a length from the feed point to the third end of the third line of the antenna element is a length corresponding to three-quarters of an electrical length of a wavelength at a resonant frequency of the antenna element, wherein a vector of a resonant current flowing in the second line and a vector of a resonant current flowing in the third line at the resonant frequency reinforce each other, wherein the first line and the third line have a meander shape, and wherein the first line and the second line and the second line and the third line are orthogonal in relationship to each other.

2. The antenna device according to claim 1, wherein the second end is located at a position corresponding to a node of a resonant current flowing in the antenna element at the resonant frequency.

3. The antenna device according to claim 1, wherein the second end is located at a position corresponding to a length of 0.0698 times to 0.5070 times the electrical length of the wavelength at the resonant frequency.

4. The antenna device according to claim 1, wherein a length from the feed point to the first end of the first line is a length corresponding to a length less than or equal to three-tenths of the electrical length of the wavelength at the resonant frequency.

5. The antenna device according to claim 1, wherein a scalar magnitude of a resultant vector obtained by combining the vector of the resonant current flowing in the second line and the vector of the resonant current flowing in the third line at the resonant frequency is greater than a scalar magnitude of a vector of a resonant current flowing at the resonant frequency in a monopole antenna extending from the feed point.

6. The antenna device according to claim 1, wherein the first line extends vertically from the first surface.

7. The antenna device according to claim 1, wherein a height of the second line and a height of the third line relative to the first surface are equal.

8. The antenna device according to claim 1, wherein an angle of an extending direction of the third line in plan view relative to an extending direction of the second line is a right angle.

9. The antenna device according to claim 1, wherein the feed point is disposed proximate to the first surface.

10. A wireless communication apparatus comprising:

an antenna device; and a feeding circuit that feeds the antenna device, the antenna device including a ground plane, and an antenna element formed on a first surface of the ground plane, the antenna element including a feed point, a first line extending from the feed point to a first end entirely in a direction away from the first surface, a second line extending along the first surface of the ground plane from the first end of the first line to a second end, and a third line extending along the first surface of the ground plane from the second end of the second line to a third end in a direction different in plan view from an extending direction of the second line, wherein a length from the feed point to the third end of the third line of the antenna element is a length corresponding to three-quarters of an electrical length of a wavelength at a resonant frequency of the antenna element, wherein a vector of a resonant current flowing in the second line and a vector of a resonant current flowing in the third line at the resonant frequency reinforce each other, wherein the first line and the third line have a meander shape, and wherein the first line and the second line and the second line and the third line are orthogonal in relationship to each other.

* * * * *